United States Patent [19]

Mori et al.

[11] 4,095,401

[45] Jun. 20, 1978

[54] METHOD AND APPARATUS FOR STOPPING A FLYER FRAME

[75] Inventors: Mitsuo Mori, Toyota; Katsumi Nakane, Okazaki; Hideo Hirano, Aichi, all of Japan

[73] Assignee: Kabushiki Kaisha Toyoda Jidoshokki Seisakusho, Japan

[21] Appl. No.: 692,227

[22] Filed: Jun. 2, 1976

[51] Int. Cl.[2] ..... D01H 13/16

[52] U.S. Cl. ..... 57/81; 57/156

[58] Field of Search ..... 57/71, 78–81, 57/156

[56] References Cited

U.S. PATENT DOCUMENTS

| | | | |
|---|---|---|---|
| 2,704,430 | 3/1955 | Harris | 57/81 |
| 3,043,991 | 7/1962 | Schneider et al. | 57/81 X |
| 3,099,829 | 7/1963 | Namenyi-Katz | 57/81 X |
| 3,114,233 | 12/1963 | Guri | 57/81 |
| 3,309,859 | 3/1967 | Vehorn | 57/81 |
| 3,438,189 | 4/1969 | Gasser et al. | 57/81 |

*Primary Examiner*—John Petrakes

*Attorney, Agent, or Firm*—Burgess, Ryan and Wayne

[57] ABSTRACT

Method and apparatus for stopping a flyer frame at the time a roving breakage occurs in an outer layer of any roving package during the spinning operation thereof. When such roving breakage occurs, an abnormal amount of floating flies separated from the broken end portions of the roving scatter in the space between the twisting and winding mechanisms. Such abnormal amount of flies interrupt a light beam emitted from a light emitter, disposed at a position adjacent to and outside one end of the alignment of the twisting and winding flying mechanisms, toward a light receiver, disposed adjacent to and outside, but at the other end, of said alignment. When such interruption occurs the light receiver issues a signal indicating the interruption of the light beam to a power supply relay via a particular control circuit which identifies the abnormal amount of floating flies from the usual amount of floating flies. Therefore, when the control circuit identifies the signal corresponding to the abnormal amount of floating flies, the signal issued from the light receiver actuates the power supply relay so as to stop the flyer frame.

6 Claims, 6 Drawing Figures

METHOD AND APPARATUS FOR STOPPING A FLYER FRAME

SUMMARY OF THE INVENTION

This invention relates to a method and an apparatus for stopping a flyer frame at the time of a roving breakage in any roving package during the spinning operation thereof.

Generally, it is well known that, in each unit of a flyer frame, a roving delivered from a pair of front rollers of a draft mechanism of the unit is introduced into a flyer twisting and winding unit, wherein the twisted roving passes through a hollow leg of the flyer and is wound about a bobbin mounted on a spindle via a presser. In this operation of twisting and winding the roving, floating fly waste or a block or blocks of fibers adhered to a portion or portions of the roving passage in the flyer are sometimes combined with the roving running through the roving passage. If a floating fly-waste or a block or blocks of fibers are combined with a part of the running roving, such part of the running roving becomes a weak point against a certain tensile force imparted thereto.

During the above-mentioned twisting and winding operation, the twisting and winding flyer mechanism of each unit of the flyer frame is driven at a predetermined variable speed. Due to the centrifugal force of the twisted roving, a certain instant tension is created in the outer layer of the roving package, which has been formed on a bobbin supported by a spindle of the twisting and winding flyer mechanism, in addition to the winding tension of the roving. If this additional tension exceeds the tensile strength of the above-mentioned weak point of the roving in the outer layer of the instant roving package, the roving is broken at the above-mentioned weak point. Such type of roving breakage in the outer layer of the roving package during the twisting and winding operation of the flyer frame is hereinafter referred to as roving breakage in the outer layer of the roving package.

It is known that the magnitude of the above-mentioned additional tension changes in proportion to the square of the rotational speed and diameter of the instant roving package. This proportional change of the additional tension has become critical recently because of the tendency to increase the driving speed of each twisting and winding flyer mechanism of the flyer frame and to increase the size of the intended full roving package. That is, because of the recent tendency to increase both the driving speed of the twisting and winding mechanisms and the size of the intended full roving package, the above-mentioned additional tension frequently exceeds the tensile strength of the above-mentioned weak point in the outer layer of the instant roving package, which has been formed on the bobbin, so that the roving is broken at this weak point.

When the roving in the outer layer of the instant roving package is broken, it is essential to stop the driving of the flyer frame or, otherwise, very serious problems can occur. That is, in such a condition, the broken end portion of the roving in the outer layer of the instant package is separated from the roving and fiber tufts are scattered in the atmosphere so that a large number of floating fiber tufts are created. Such floating fiber tufts, which are known as flies, can be caught by running rovings passing in the twisting and winding mechanisms and, if this occurs, the running roving may possibly be broken. Besides such the possibility of such problems, it is necessary to stop the driving of the flyer frame so as to piece the broken roving. This piecing operation is carried out manually. Such manual operation must be carried out in a skilled manner or, otherwise, the thickness of the pieced portion of the roving becomes very large or very small in comparison with the thickness of the normal portion of the roving. If such an irregular thickness portion is formed on the outer layer of the instant roving package during the manual piecing operation of the broken portion of the roving, when a presser of the flyer comes to the above-mentioned pieced portion of the roving in the successive winding operation for forming the next outer layer of the roving package, the smooth action of the pressure is disturbed so that the roving is possibly wound on the previous outer layer of the roving package in loose condition or the roving is broken and, consequently, the further successive operation of the twisting and winding mechanism can not be continued. If the flyer frame is frequently stopped, the productive efficiency of the flyer frame is remarkably reduced, so that the balance between the production of the full size roving package by the flyer frame and the consumption of the full size package in the successive process is broken and, consequently, a reduction of the productivity of the spinning process can not be prevented.

In view of the above, very effective detection of roving breakage in the outer layer of a roving package and a method for stopping the flyer frame before creating the above-mentioned problems have recently become vital in spinning factories due to the tendency to increase the driving speed of the twisting and winding mechanisms and the size of the intended full roving package.

The object of the present invention is to provide the method for detecting the creation of a roving breakage in the outer layer of the instant roving package and stopping the running of the flyer frame as soon as possible so as to prevent the creation of spinning problems due to the creation of the roving breakage, and an apparatus for carrying out the method.

To attain the purpose of the present invention, in the apparatus for a flyer frame when a roving breakage takes place in an outer layer of a roving package during the twisting and winding operation, according to the present invention, a photoelectric device for detecting roving breakage in the outer layer of a roving package is utilized. In this device, at least one set of a light emitter and a light receiver is disposed at a position adjacent to the arrangement of a plurality of units of the twisting and winding mechanism of a flyer frame in such a condition that the light emitter is disposed at a position adjacently outside of the lengthwise arrangement of the twisting and winding flyer mechanisms while the light receiver is disposed at a position adjacently outside the other side of the above-mentioned lengthwise arrangement of the twisting and winding flyer mechanisms. In this light receiver, a photoelectric tube, disposed therein, is capable of receiving the projected light from the light emitter without being interrupted by the flyers and roving packages of these twisting and winding flyer mechanisms, but its capability to receive the projected light is interrupted by flies scattered from the broken end of the roving when a roving breakage is created in a certain twisting and winding flyer mechanism. Means for stopping the driving of the flyer frame is actuated by a signal issued from the detector when the projected light from the light emitter is interrupted by the above-mentioned flies. A particular control circuit is applied for an electric circuit connected the photoelectric tube and the stop means so as to ensure the perfect actuation of the stop means by the signal issued from the photoelectric tube when a roving breakage occurs in the outer layer of the instant roving package. That is, if the light beam comes into the photoelectric tube is successively interrupted by flies floating in the space between the twisting and winding flyer mechanisms, the control circuit receives successively interrupted output signal from the photoelectric tube. This control circuit is provided with such a function of identifying the electric condition corresponding to abnormal creation of floating flies scattering from the broken portion of the roving breakage, from the electric condition corresponding to normal flies floating in the above-mentioned space. When the control circuit identifies the electric condition corresponding to the above-mentioned abnormal creation of floating flies, the control circuit actuates means for stopping the driving mechanism of the flyer frame.

As mentioned above, the possible problems due to the scattering of the fiber tufts from the roving bobbin can be effectively prevented by the method and apparatus for detecting the roving breakage in the outer layer of the roving package and the stopping of the flyer frame according to the present invention.

DETAILED EXPLANATION OF THE INVENTION

For the sake of a clearer understanding the present invention, the twisting and winding operation of the roving in a unit of the conventional flyer frame is briefly explained first.

Figure 1:
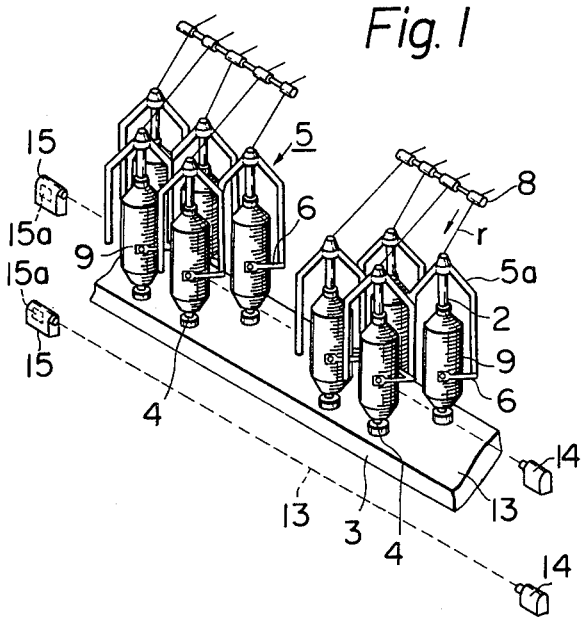
FIG. 1 is a schematic perspective view of a front portion of a flyer frame provided with the detector according to the present invention.
Figure 2:
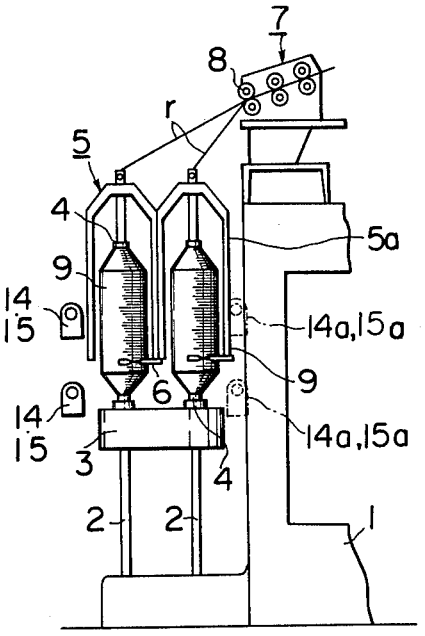
FIG. 2 is a schematic side view of a twisting and winding mechanism together with a draft mechanism of the flyer shown in FIG. 1.

Referring to FIGS. 1 and 2, in the conventional flyer frame a plurality of twisting and winding units are arranged on a bobbin frame 3 in two parallel alignments along the longitudinal direction of the flyer frame. In each twisting and winding unit, a fibrous strand dilivered from a pair of front rollers 8 of a corresponding draft unit 7 is introduced into an aperture formed on a central top portion of a flyer 5 and then introduced to a presser 6 of the flyer by way of a hollow leg 5*a*. When the fibrous strand is delivered from the front rollers 8, twists are imparted to the fibrous strand according to the rotation of the flyer 5 so that a twisted roving *r* is formed. The twisted roving *r* is wound into a roving package 9 about a bobbin 4 mounted on a rotatable bobbin holder 4*a* (FIG. 3), in a coaxial condition with a spindle 2 which rotates together with the flyer 5 by means of a building motion mechanism (not shown). The bobbin rail 3 is reciprocally displaced upward and downward while the rotatable bobbin holder 4*a* of each twisting and winding flyer mechanism is displaced togher with the bobbin rail 3. The range of diaplacement of the above-mentioned reciprocal motion of the bobbin rail 3 is gradually reduced so as to build a roving package 9 of the twisted roving *r* on the bobbin 4.

Figure 3:
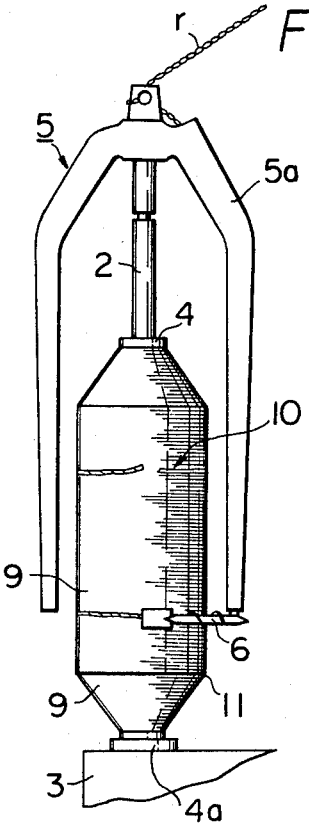
FIG. 3 is a side view of a roving package formed on a bobbin mounted on a twisting and winding mechanism, wherein a roving breakage has occurred in an outer layer thereof.
Figure 4:
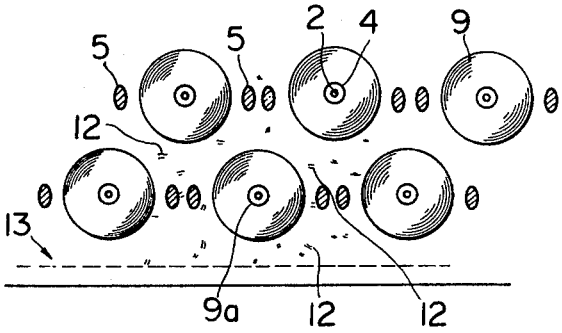
FIG. 4 is a schematic plan view of a part of the alignment of twisting and winding mechanisms forming roving packages wherein a roving breakage has occurred in an outer layer of one of these roving packages.

In FIG. 3, a condition is shown wherein a roving breakage was created at a point 10 in the outer layer of the twisted roving *r* during the upward displacement of the bobbin 4, according to the motion of the bobbin rail 3; then, the bobbin 4 was displaced to a terminal of its upward displacement which corresponds to a position indicated by a reference numeral 11; thereafter, the bobbin 4 was displaced downward by the downward motion of the bobbin rail 3 to a position shown in FIG. 3, where the presser 6 of the flyer 5 guides the twisted roving *r*. Since the twisted roving *r* was broken at the point 10 in the outer layer of the roving package, fiber tufts are separated from the broken end portions of the roving *r* by the rotation of the roving package 9 until such broken portion of the roving package 9 is covered by a new winding of the twisted roving *r* in accordance with the downward motion of the bobbin rail 3. The above-mentioned separated fiber tufts are scattered into the atmosphere by air currents created by the rotation of the flyers 5 and roving packages 9 of the twisting and winding flyer mechanisms of the flyer frame. FIG. 4 indicates a condition wherein the roving breakage is created in the outer layer of the roving package 9*a* and the fiber tufts 12 are floating in the atmosphere in the space between the twisting and winding flyer mechanisms adjacent to the roving package 9*a*.

A preferable embodiment of the apparatus for stopping a flyer frame at the time a roving breakage takes place in any roving package during the spinning operation thereof, according to the present invention, is hereinafter explained in detail.

Referring to FIGS. 1, 2, 3 and 4, two sets of photoelectric devices, each comprising a light emitter 14 and a light receiver 15 provided with a photoelectric tube 15*a* which is capable of issuing an output signal when a light projected from the light emitter is interrupted, are disposed at the respective positions shown, adjacent to the upward and downward displacing passage of the bobbin rail 3. That is, the sets of photoelectric devices are positioned in such a manner that, one of photoelectric devices is positioned at a relatively lower level while the other photoelectric device is positioned at a relatively higher level, the light emitter 14 of each device being disposed at a position adjacently outside of the lengthwise arrangement of the twisting and winding mechanisms while the light receiver 15 of each device is disposed at a position adjacently outside of the above-mentioned lengthwise arrangement of the twisting and winding mechanisms as shown in FIG. 1. In the above-mentioned disposition of the photoelectric devices, the light beam 13 emitted from the light emitter 14 of each device is directed to the photoelectric tube 15*a* of the corresponding light receiver 15, without being disturbed by the flyer 5 and the roving package 9 of each unit of the twisting and winding flyer mechanism. Since two sets of photoelectric detecting devices are utilized in the above-mentioned embodiment, and these sets are each positioned at a different level from each other in the passage of the upward and downward motion of the bobbin rail 3, when a roving breakage takes place in an outer layer of any one of roving packages 9 during the operation of the flyer frame, the space for detecting the possible generation of a roving breakage in an outer layer of anyone of the roving packages 9 can be enlarged in comparison with the case where only one photoelectric detecting device is utilized. In the embodiment shown in FIG. 1, these photoelectric detecting devices are positioned at the front side of the aligned twisting and winding flyer mechanisms, however, it is possible to dispose them at the rear side of the aligned twisting and winding flyer mechanisms as shown with a dot-dash line in FIG. 2, wherein these alternative light emitters and light receivers are represented by 14*a* and 15*a*, respectively.

Figure 5:
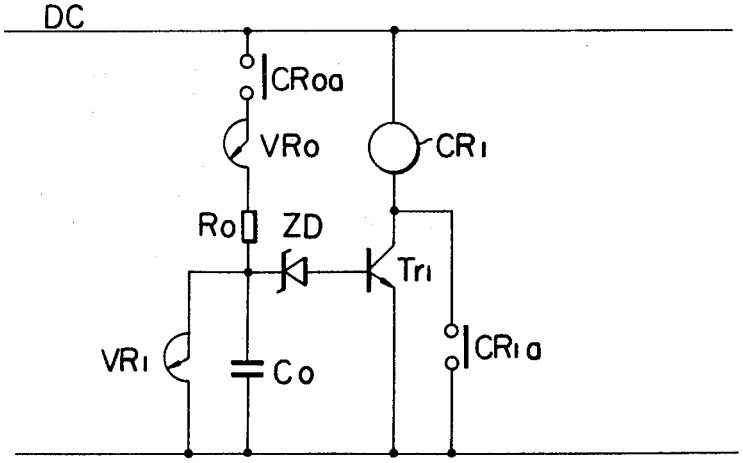
FIG. 5 is a diagram of an electric control circuit applied to the detector of the stopping apparatus according to the present invention.

As already explained, a particular control circuit is applied so as to effectively transmit the signal issued from the photocell to a means for stopping the driving of the flyer frame entirely. One preferable embodiment of this particular control circuit is hereinafter explained with reference to FIG. 5. In the control circuit shown in FIG. 5, when the light beam 13 (FIG. 1) emitted from the light emitter 14 toward the photoelectric tube 15*a* of the corresponding light receiver 15 is interrupted by something such as a floating fly, an output terminal $CR_{0a}$ of the photoelectric tube 15*a* is changed from the OFF condition to ON condition. The output terminal $CR_{0a}$ of the photoelectric tube 15*a* is connected to a direct current source DC via a capacitor $C_0$, a fixed resistor $R_0$ and a variable resistor $VR_0$. A variable resistor $VR_1$, which adjusts the charging and discharging time of the capacitor $C_0$, connects the fixed resistor $R_0$ and the direct current source DC in parallel condition to the capacitor $C_0$. A relay $CR_1$ is connected to the direct current source DC via a collector terminal and an emitter terminal of a transistor $Tr_1$. A normally opened contact $CR_{1a}$ of the relay $CR_1$ as a self-holding means of the relay $CR_1$ is inserted between the collector and emitter terminals of the transistor $Tr_1$. A terminal voltage of the capacitor $C_0$ is applied to a base terminal of the transistor $Tr_1$ via a zener diode ZD. Further, a normally closed contact (not shown) of the relay $CR_1$ is connected in series with a power source circuit of the flyer frame. By actuation of the relay $CR_1$, the power source circuit is opened so that the driving of the flyer frame is stopped. The operation of the embodiment of the photoelectric device constructed as stated before as well as the stopping method of the flyer frame when the roving breakage takes place in an outer layer of any one of the roving packages during the spinning operation, according to the present invention, will be hereinafter explained in detail.

As mentioned previously, in the operation of the flyer frame, twists are imparted to a strand of fibers delivered from the front rollers 8 and the twisted roving *r* is introduced into the hollow leg 5*a* of the flyer 5 via an aperture formed at the top central portion of this flyer 5. Then the twisted roving *r* is wound about the bobbin 4 at a position facing the presser 6. When the twisting and winding operation is carried out under the normal condition, the light beam 13 emitted from the light emitter 14 to the corresponding receiver 15 is sometimes interrupted by the fly floating in the space adjacent to the twisting and winding mechanism. In a case where the light beam 13 is interrupted only intermittently by the small floating fly, even though the output contact $CR_{0a}$ intermittently repeats ON and OFF operations in response to the interruption of the light beam, the energy charged in the capacitor $C_0$ is almost completely discharged through the variable resistor $VR_1$ every time said output contact operates, and; consequently, the terminal voltage $V_0$ of the capacitor $C_0$ never reaches a predetermined zener voltage of the zener diode ZD. Therefore, in such a case, the relay $CR_1$ is kept in an OFF condition so that the machine continues its normal operation (see a range A in FIG. 6).

Figure 6:
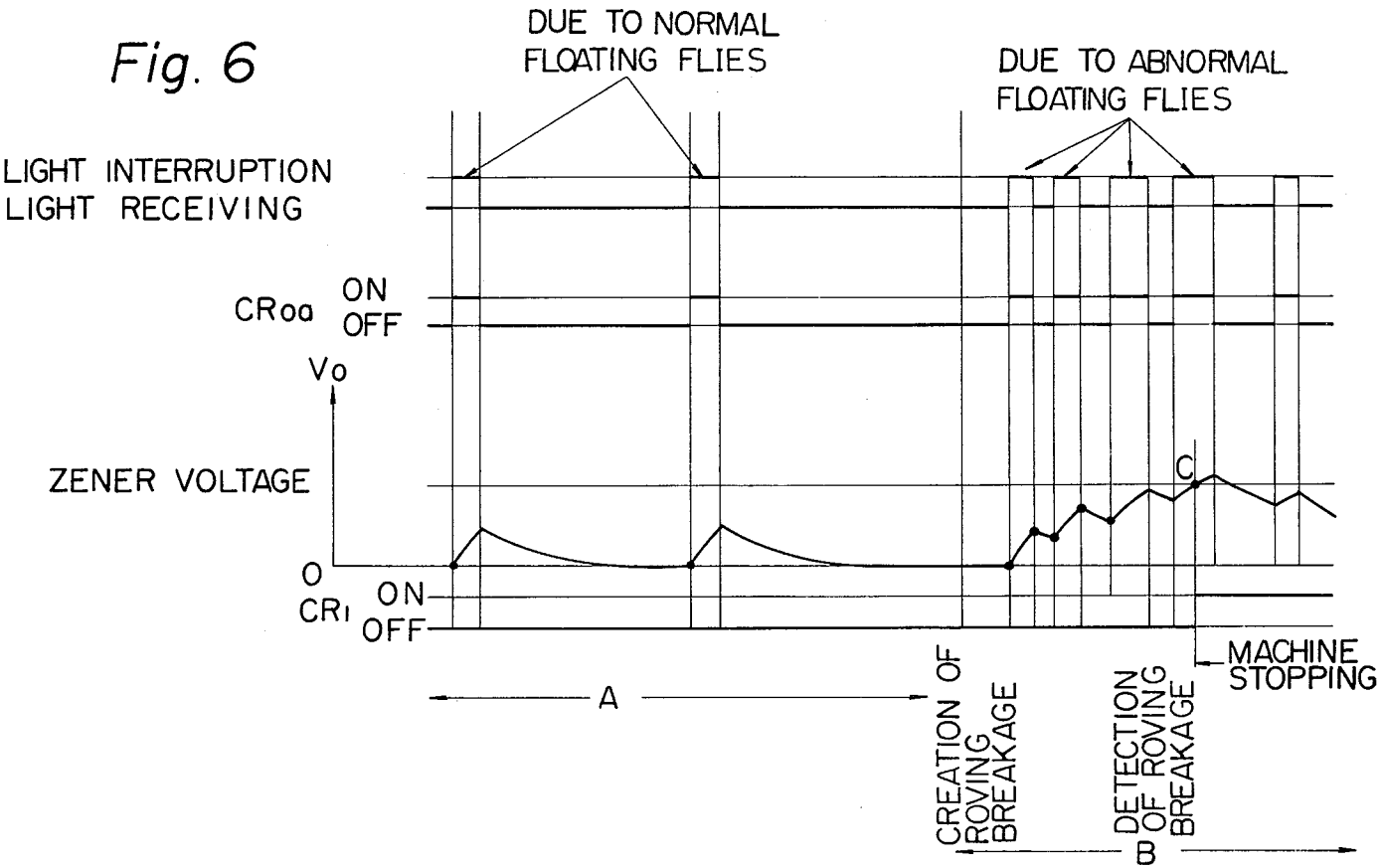
FIG. 6 is a diagram indicating the operation of the detector and the control circuit applied thereto according to the present invention.

Next, when roving breakage takes place in an outer layer of any one of the roving packages under the above-mentioned normal winding condition, fiber tufts are separated from the ends of the roving breakage and/or the broken end portions of the roving contact with the corresponding flyer 5 and other portions of the apparatus, so that numerous floating flies 13 scattered in the neighboring atmosphere are created. These abnormal floating flies, consisting of large and small size fiber tufts frequently interrupt the light beam 13 emitted to the photoelectric tube 15*a*. In response to this, the output contact $CR_{0a}$ of the photoelectric tube 15*a* almost continuously repeats the ON and OFF operations, as indicated by a range B in FIG. 6. Consequently, before the charged energy in the capacitor $C_0$ is completely discharged, the next charging is applied to it as shown in FIG. 6. After frequent repetitions of the charging and discharging operations in a short period, the charging voltage $V_0$ of the capacity $C_0$ finally reaches the predetermined zener voltage of the zener diode ZD (at C in FIG. 6). This voltage is applied to the base terminal of the transistor $Tr_1$, the transistor changes from OFF to ON and, simultaneously, the stopping relay $CR_1$ is actuated and maintained in a self-holding condition through the normally opened contact $CR_{1a}$ of the relay $CR_1$. As a result, the normally closed contact of the relay $CR_1$ is opened, so that the electric power source of the flyer frame is cut off, and the machine is stopped.

Since the above-mentioned electric circuit is provided with variable resistors $VR_0$ and $VR_1$ capable of adjusting the charging time and discharging time, respectively, the condition wherein the floating flies are created from a roving breakage in an outer layer of any one of the roving packages during the operation of the flyer frame and the condition wherein the floating flies are the result of the operation of the flyer frame can be definitely distinguished from each other. As mentioned above, when the light beam 13 emitted from the light emitter 14 is interrupted by the abnormal amount of floating flies created by a roving breakage in an outer layer of a roving package, the breakage is detected by the photoelectric tube 15*a* of the light receiver 15 provided with the above-mentioned control circuit without fail. As a result of this detection, the means for driving the flyer frame receives an output signal from the control circuit so that the driving of the flyer frame is quickly stopped.

As mentioned above, the method and apparatus for stopping the flyer frame when a roving breakage occurs in an outer layer of any one of roving packages during the spinning operation, according to the present invention, has the following features and advantages.

Since the operation to identify or distinguish between the usual floating flies and the abnormal amount of floating flies due to a roving breakage occurring in an outer layer of any one of roving packages can be carried out automatically by the detector according to the present invention without any detecting error or mis-operation, the flyer frame can be correctly and effectively stopped at the time a roving breakage takes place. Such quick stop motion of the flyer frame prevents serious problems resulting from further scattering of the abnormal amount of floating flies separated from the broken portion of the roving in the outer layer of the roving package wherein the above-mentioned roving breakage occurred. Consequently, possible damage to the quality of the roving package due to the above-mentioned roving breakage can be preferably prevented. Moreover, even if the roving breakage takes place in an outer layer of a roving package of any one of the twisting and winding flyer mechanisms, since the flyer frame can be quickly stopped by utilization of the stopping apparatus according to the present invention, any damage, due to increasing the above-mentioned abnormal amount of floating flies, imparted to the running rovings or roving packages of the twisting and winding mechanisms located at the respective positions adjacent to the twisting and winding mechanisms where the roving breakage took place, can be effectively prevented so that, in the above-mentioned condition, the driving ofthe flyer frame can be started again after only piecing the broken portion of the roving in the outer layer of the roving package. Consequently, the working efficiency of the flyer frame can be increased, particularly in the case of high speed driving a flyer frame utilizing large package.

In the apparatus according to the present invention, since very simple electrical elements are utilized for constructing the detector, the conventional flyer frame can be modified with the apparatus according to the present invention at a very reasonable modification cost.

What is claimed is:

1. A method for stopping the movement of a flyer frame provided with a plurality of twisting and winding flyer mechanisms at the time a roving breakage occurs in an outer layer of any roving package during the spinning operation thereof, by utilizing at least one photoelectric detecting device provided with a light emitter and a light receiver which is capable of generating a signal whenever a light beam projected from said light emitter toward said receiver is interrupted, comprising:

projecting a light beam from said light emitter toward said light receiver along a light beam path passing through a space between and adjacent said plurality of flyer mechanisms in parallel relation to the lengthwise direction of said flyer frame;

generating a monitoring signal from said receiver signal having a magnitude which corresponds to the frequency of interruption of said light beam; and stopping the movement of said flyer frame when the magnitude of said monitoring signal exceeds a predetermined threshold value, said threshold value being selected so that said frame movement is not stopped due to periodic interruption of said light beam by the normal amount of floating flies present in the absence of any roving breakage.

2. An apparatus for stopping the movement of a flyer frame provided with a plurality of twisting and winding flyer mechanisms at the time a roving breakage occurs in an outer layer of any roving package during the spinning operation thereof, said flyer frame being provided with a driving means therefor, comprising:

a detector including a photoelectric detecting device for detecting floating flies in a space between said flyer mechanisms;

a control circuit connected to said detecting device for generating a monitoring signal having a magnitude corresponding to the frequency of detection of floating flies by said device; p1 switching means connected to said control circuit for disabling said driving means when the magnitude of said monitoring signal exceeds a predetermined threshold value;

said photoelectric detecting device comprising a light emitter disposed at a position adjacent to and outside one end of the arrangement of said flyer mechanisms and a light receiver comprising a photoelectric light receiving element disposed adjacent to, outside, and at the other end of said arrangement of said flyer mechanisms so that a light beam projected from said light emitter toward said light receiver is passed through a space between said flyer mechanisms parallel to the lengthwise direction of said flyer frame, said light receiver being capable of generating an output signal when said light beam is interrupted;

said control circuit comprising a capacitor and a discharging and charging circuit which discharges or charges said capacitor with a predetermined time constant whenever said output signal is present, and a switching circuit for actuating said switching means to disable said driving means when the voltage across said capacitor exceeds a predetermined value, said predetermined values being such that said driving means is not disabled by periodic interruption of said light beam by the normal amount of floating flies present in the absence of any roving breakage.

3. An apparatus for stopping the driving of a flyer frame according to claim 2, wherein said detector comprises plural sets of photoelectric detecting devices disposed at different levels above a bobbin rail of said flyer frame.

4. An apparatus for stopping the driving of a flyer frame according to claim 2, wherein said photoelectric light receiving element is a photoelectric tube.

5. An apparatus for stopping the driving of a flyer frame according to claim 2, wherein said control circuit is provided with a variable resistor which is capable of adjusting the charging and discharging time of said capacitor.

6. An apparatus for stopping the driving of a flyer frame according to claim 2, wherein said control circuit includes a transistor, said switching means comprising a relay connected to said electric power source via a collector terminal and an emitter terminal of said transistor, said relay having normally open contacts connected in series between said collector terminal and said emitter terminal of said transistor as a self-holding means of said relay, one terminal of said capacitor being coupled to a base terminal of said transistor via a zener diode.

* * * * *

UNITED STATES PATENT OFFICE

CERTIFICATE OF CORRECTION

Patent No. 4,095,401 Dated June 20, 1978

Inventor(s) Mitsuo Mori, et al

It is certified that error appears in the above-identified patent and that said Letters Patent are hereby corrected as shown below:

Column 8, line 10: Cancel "pl";

"switching means" should start a new paragraph.

Signed and Sealed this

Sixth Day of March 1979

[SEAL]

Attest:

RUTH C. MASON
*Attesting Officer*

DONALD W. BANNER
*Commissioner of Patents and Trademarks*